US008492992B2

(12) United States Patent
Otake et al.

(10) Patent No.: US 8,492,992 B2
(45) Date of Patent: Jul. 23, 2013

(54) LED LIGHTING DEVICE AND ILLUMINATION APPARATUS

(75) Inventors: Hirokazu Otake, Yokosuka (JP); Kenichi Asami, Yokosuka (JP)

(73) Assignee: Toshiba Lighting & Technology Corporation, Yokosuka-shi, Kanagawa (JP)

( * ) Notice: Subject to any disclaimer, the term of this patent is extended or adjusted under 35 U.S.C. 154(b) by 126 days.

(21) Appl. No.: 12/885,053

(22) Filed: Sep. 17, 2010

(65) Prior Publication Data

US 2011/0068706 A1 Mar. 24, 2011

(30) Foreign Application Priority Data

Sep. 18, 2009 (JP) ..... 2009-216751

(51) Int. Cl.
*H05B 37/02* (2006.01)

(52) U.S. Cl.
USPC ..... 315/291

(58) Field of Classification Search
USPC ..... 315/307–308, 291, 224, 244, 200 R, 315/209 R, 246–247
See application file for complete search history.

(56) References Cited

U.S. PATENT DOCUMENTS 5,811,941 A * 9/1998 Barton ..... 315/307
5,834,924 A * 11/1998 Konopka et al. ..... 323/222
6,153,980 A 11/2000 Marshall
6,628,093 B2 9/2003 Stevens
6,747,420 B2 6/2004 Barth et al.
6,787,999 B2 9/2004 Stimac et al.
6,998,792 B2 * 2/2006 Takahashi et al. ..... 315/248
7,081,709 B2 * 7/2006 Pak ..... 315/101
7,164,235 B2 * 1/2007 Ito et al. ..... 315/82
7,202,608 B2 4/2007 Robinson et al.
7,262,559 B2 8/2007 Tripathi et al.
7,557,520 B2 7/2009 Chen et al.
7,564,434 B2 7/2009 Kim
7,595,229 B2 9/2009 Ihme et al.
7,791,326 B2 9/2010 Dahlman et al.

(Continued)

FOREIGN PATENT DOCUMENTS

EP 2257130 12/2010
JP 11-087072 3/1999

(Continued)

OTHER PUBLICATIONS

English language abstract of JP 2008-210537, published Sep. 11, 2008.

(Continued)

*Primary Examiner* — Minh D A
(74) *Attorney, Agent, or Firm* — Banner & Witcoff, Ltd.

(57) ABSTRACT

The present invention provides an LED lighting device including: a rectifying circuit having AC input ends connected to an AC source; a converter which has input ends connected to DC output ends of the rectifying circuit and output ends, to which an output capacitor is connected in parallel, connected to an LED, and lights the LED; a control unit for changing continued DC output current of the converter in accordance with a dimming degree; and a bypass circuit which is connected to the output ends of the converter in parallel with the output capacitor and makes bypass current flow, the bypass current being larger than lighting current, which flows through the LED, at least in the vicinity of a dimming lower limit.

2 Claims, 6 Drawing Sheets

U.S. PATENT DOCUMENTS

| | | | | |
|---|---|---|---|---|
| 7,804,256 | B2 | 9/2010 | Melanson | |
| 7,855,520 | B2 | 12/2010 | Leng | |
| 7,906,617 | B2 | 3/2011 | Cunningham et al. | |
| 7,999,484 | B2 | 8/2011 | Jurngwirth et al. | |
| 8,013,544 | B2 | 9/2011 | Negrete et al. | |
| 8,018,171 | B1 | 9/2011 | Melanson et al. | |
| 8,018,173 | B2 | 9/2011 | Shackle et al. | |
| 8,044,608 | B2 | 10/2011 | Kuo et al. | |
| 8,076,867 | B2 | 12/2011 | Kuo et al. | |
| 8,076,920 | B1 | 12/2011 | Melanson | |
| 8,093,826 | B1 | 1/2012 | Eagar et al. | |
| 8,102,127 | B2 | 1/2012 | Melanson | |
| 8,134,304 | B2 | 3/2012 | Hsu et al. | |
| 2005/0253533 | A1 | 11/2005 | Lys | |
| 2006/0071614 | A1 | 4/2006 | Tripathi et al. | |
| 2006/0192502 | A1 | 8/2006 | Brown | |
| 2006/0238174 | A1 | 10/2006 | Russell | |
| 2006/0261754 | A1 | 11/2006 | Lee | |
| 2007/0182347 | A1 | 8/2007 | Shteynberg et al. | |
| 2007/0188112 | A1 | 8/2007 | Kang et al. | |
| 2007/0216320 | A1 | 9/2007 | Grivas | |
| 2008/0012502 | A1 | 1/2008 | Lys | |
| 2008/0054817 | A1 | 3/2008 | Kao et al. | |
| 2008/0074058 | A1 | 3/2008 | Lee et al. | |
| 2008/0258647 | A1* | 10/2008 | Scianna | 315/291 |
| 2008/0259655 | A1 | 10/2008 | Wei et al. | |
| 2008/0316781 | A1 | 12/2008 | Liu | |
| 2009/0021470 | A1 | 1/2009 | Lee | |
| 2009/0079363 | A1 | 3/2009 | Ghoman | |
| 2009/0116232 | A1 | 5/2009 | Chang | |
| 2009/0121641 | A1 | 5/2009 | Shih | |
| 2010/0207536 | A1 | 8/2010 | Burdalski | |
| 2010/0289426 | A1 | 11/2010 | Takasaka | |
| 2010/0308742 | A1 | 12/2010 | Melanson | |
| 2011/0291587 | A1 | 12/2011 | Melanson et al. | |

FOREIGN PATENT DOCUMENTS

| | | | |
|---|---|---|---|
| JP | 2001-210478 | | 8/2001 |
| JP | 2002-231471 | | 8/2002 |
| JP | 2003-157986 | | 5/2003 |
| JP | 2004-119078 | | 4/2004 |
| JP | 2004-265756 | | 9/2004 |
| JP | 2004-327152 | | 11/2004 |
| JP | 2005-011739 | | 1/2005 |
| JP | 2005-129512 | | 5/2005 |
| JP | 2006-108117 | | 4/2006 |
| JP | 2006-269349 | | 10/2006 |
| JP | 2006-319172 | A | 11/2006 |
| JP | 2007-6658 | | 1/2007 |
| JP | 2007-234415 | | 9/2007 |
| JP | 2007-281424 | | 10/2007 |
| JP | 2007-306644 | | 11/2007 |
| JP | 2007-538378 | | 12/2007 |
| JP | 2008-053695 | | 3/2008 |
| JP | 2008-210537 | | 9/2008 |
| JP | 2008-310963 | | 12/2008 |
| JP | 2009-170240 | A | 7/2009 |
| JP | 2009-218528 | | 9/2009 |
| JP | 2009-232625 | | 10/2009 |
| WO | WO 99/56504 | | 11/1999 |
| WO | WO 2005/115058 | | 12/2005 |
| WO | WO 2009/055821 | | 4/2009 |
| WO | WO 2009/119617 | | 10/2009 |

OTHER PUBLICATIONS

Machine English language translation of JP 2008-210537, published Sep. 11, 2008.
English language abstract of JP-2008-053695 published Mar. 6, 2008.
Machine English language translation of JP-2008-053695 published Mar. 6, 2008.
English language abstract of JP-2007-538378 published Dec. 27, 2007.
Machine English language translation of JP-2007-538378 published Dec. 27, 2007.
English language abstract of JP 2005-11739 published Jan. 13, 2005.
Machine English language translation of JP 2005-11739 published Jan. 13, 2005.
English language abstract of JP 11-087072 published Mar. 30, 1999.
Machine English language translation of JP 11-087072 published Mar. 30, 1999.
English Language Abstract of JP 2009-218528 Published Sep. 24. 2009.
English Language Translation of JP 2009-218528 Published Sep. 24, 2009.
English Language Abstract of JP 2004-119078 Published Apr. 15, 2004.
English Language Translation of JP 2004-119078 Published Apr. 15, 2004.
English Language Abstract of JP 2007-6658 Published Jan. 11, 2007.
English Language Translation of JP 2007-6658 Published Jan. 11, 2007.
English Language Abstract of JP 2003-157986 Published May 30, 2003.
English Language Translation of JP 2003-157986 Published May 30, 2003.
English Language Abstract of JP 2008-310963 Published Dec. 25, 2008.
English Language Translation of JP 2008-310963 Published Dec. 25, 2008.
International Search Report issued in PCT/JP2009/055871 on Jun. 9, 2009.
English Language Abstract of JP 2002-231471 Published Aug. 15, 2002.
English Language Translation of JP 2002-231471 Published Aug. 15, 2002.
English Language Abstract of JP 2004-327152 Published Nov. 18, 2004.
English Language Translation of JP 2004-327152 Published Nov. 18, 2004.
English Language Abstract of JP 2005-129512 Published May 19, 2005.
English Language Translation of JP 2005-129512 Published May 19, 2005.
English Language Abstract of JP 2007-234415 Published Sep. 13, 2007.
English Language Translation of JP 2007-234415 Published Sep. 13, 2007.
English Language Abstract of JP 2001-210478 Published Aug. 3, 2001.
English Language Translation of JP 2001-210478 Published Aug. 3, 2001.
English Language Abstract of JP 2006-269349 Published Oct. 5, 2006.
English Language Translation of JP 2006-269349 Published Oct. 5, 2006.
International Search Report issued in PCT/JP2009/055873 on Jun. 9, 2009.
Japanese Office Action issued in JP 2008-076837 on Jul. 6, 2010.
English Translation of Japanese Office Action issued in JP 2008-076837 on Jul. 6, 2010.
English Language Abstract of JP 2006-108117 published Apr. 20, 2006.
Machine Translation of JP 2006-108117 published Apr. 20, 2006.
English Language Abstract of JP 2008-281424 published Nov. 20, 2008.
Machine Translation of JP 2008-281424 published Nov. 20, 2008.
Japanese Office Action issued in JP 2008-076835 on Aug. 24, 2010.
English Translation of Japanese Office Action issued in JP 2008-076835 on Aug. 24, 2010.
Extended European Search Report issued in European Appl. 09011497.6 on Jan. 28, 2010.
English Language Abstract of JP 2004-265756 published on Sep. 24, 2004.
English Language Translation of JP 2004-265756 published on Sep. 24, 2004.
Japanese Office Action issued in JP 2008-076837 on Nov. 24, 2010.
English Translation of Japanese Office Action issued in JP 2008-076837 on Nov. 24, 2010.

English Abstract of JP 2009-232625 published Oct. 8, 2009.
English Translation of JP 2009-232625 published Oct. 8, 2009.
English Abstract of JP 2007-306644 published Nov. 22, 2007.
English Translation of JP 2007-306644 published Nov. 22, 2007.
U.S. Appl. No. 12/777,303.
U.S. Appl. No. 12/873,348.
U.S. Appl. No. 12/874,282.
U.S. Appl. No. 12/860,528.
U.S. Appl. No. 12/557,179.
U.S. Appl. No. 12/764,995.
U.S. Appl. No. 12/873,744.
U.S. Appl. No. 12/873,759.
Extended European Search Report issued in EP 10177426.3 on May 4, 2011.
Extended European Search Report issued in EP 10162031.8 on Jul. 21, 2011.
Chinese Office Action mailed Jul. 21, 2011 in CN 201010178232.8.
English Language Translation of Chinese Office Action mailed Jul. 21, 2011 in CN 201010178232.8.
International Preliminary Report on Patentability and Written Opinion mailed Nov. 9, 2010 in PCT/JP2009/055871.
International Preliminary Report on Patentability and Written Opinion mailed Nov. 9, 2010 in PCT/JP2009/055873.
Notification of Reasons for Refusal in corresponding Japanese Patent Application No. 2009-216751, dated May 1, 2013.
First Office Action received in corresponding Chinese Patent Application No. 201010286962.X, dated Feb. 28, 2013.

* cited by examiner

LED LIGHTING DEVICE AND ILLUMINATION APPARATUS

INCORPORATION BY REFERENCE

The present invention claims priority under 35 U.S.C. §119 to Japanese Patent Application No. 2009-216751 filed on Sep. 18, 2009. The content of the application is incorporated herein by reference in its entirety.

FIELD

The present invention relates to an LED lighting device which lights an LED so that the LED can be subjected to light control, and an illumination apparatus including the LED lighting device.

BACKGROUND

Although it is said that an LED can be subjected to light control more easily than a discharge lamp, it is never easy to smoothly perform deep dimming. That is, when deep dimming is performed, flickering of the LED easily occurs due to the following reasons.

As a first reason, the LED emits light even if it is deeply dimmed and little lighting current flows, and the visual sensation of a person tends to sense flickering of the LED more clearly as the amount of light decreases.

As a second reason, when the LED is lit by continuously flowing DC current, the LED becomes a light load in a deep dimming region, an operation point vibrates in relation to a rise point of a voltage-current property of the LED as a center in accordance with a slight fluctuation in output current of a converter. Consequently, conduction and block are repeated, an unstable lighting state of the LED is shown and thus flickering of the LED occurs.

By the first and second reasons, flickering of the LED easily occurs in the LED lighting device capable of deep dimming and the quality of the device is remarkably lowered.

In order to remove flickering, a circuit system is required to be adopted which strictly manages current of an LED lighting circuit and performs pulse-control by making an amplitude of current large.

On the other hand, a two-wire phase control type dimmer using a phase control element such as a triac is widely used as a dimmer for incandescent bulbs. If an LED can be subjected to light control with use of the dimmer, a low power consumption type illumination system with a light control function can be realized only by exchanging light sources without renewing existing equipment and wiring.

However, there actually exist the following problems. That is, when the LED is lit at a low-current level, self-holding current of the phase control element of the dimmer cannot be secured and thus flickering of the LED occurs. Additionally, a timer circuit for turning on the phase control element of the dimmer at a desired phase does not operate from the moment when an AC source of the LED is switched on.

An LED lighting device is known which, in order to solve the above problems, includes a dynamic dummy load, which is arranged in parallel with a converter, receives a control signal from the converter and adjusts a load in response to the control signal, and thus feeds self-holding current of a phase control element and operation current of a timer circuit of a dimmer when each of them is required.

However, in a conventional prior art, when the above solving method is performed for suppressing flickering of the LED occurring in accordance with the slight fluctuation in current in the deep dimming region, a control circuit becomes complicated, the number of circuit components is increased in accordance with this, and thus downsizing is difficult to realize and this leads to an increase in cost.

Additionally, regarding the phase control type dimmer, although the self-holding current of the phase control element and the operation current of the timer circuit of the dimmer are properly made to flow by providing the dynamic dummy load, not only does a ripple of input voltage to the LED lighting device become large by the phase control but also a firing phase easily becomes unstable at a light load in the deep dimming region. Thus, flickering of the LED is further encouraged in the deep dimming region.

The present invention aims to provide: an LED lighting device that reduces flickering, which easily occurs in the vicinity of a dimming lower limit, of an LED by a relatively simple circuit constitution; and an illumination apparatus including the LED lighting device.

DETAILED DESCRIPTION

An LED lighting device of the embodiment includes: a rectifying circuit having AC input ends connected to an AC source; a converter which has input ends connected to DC output ends of the rectifying circuit and output ends, to which an output capacitor is connected in parallel, connected to an LED, and lights the LED; a control unit for changing continued DC output current of the converter in accordance with a dimming degree; and a bypass circuit which is connected to the output ends of the converter in parallel with the output capacitor and makes bypass current flow, the bypass current being larger than lighting current, which flows through the LED, at least in the vicinity of a dimming lower limit of the LED.

Next, a first embodiment will be described with reference to FIGS. 1 and 2.

Figure 1:
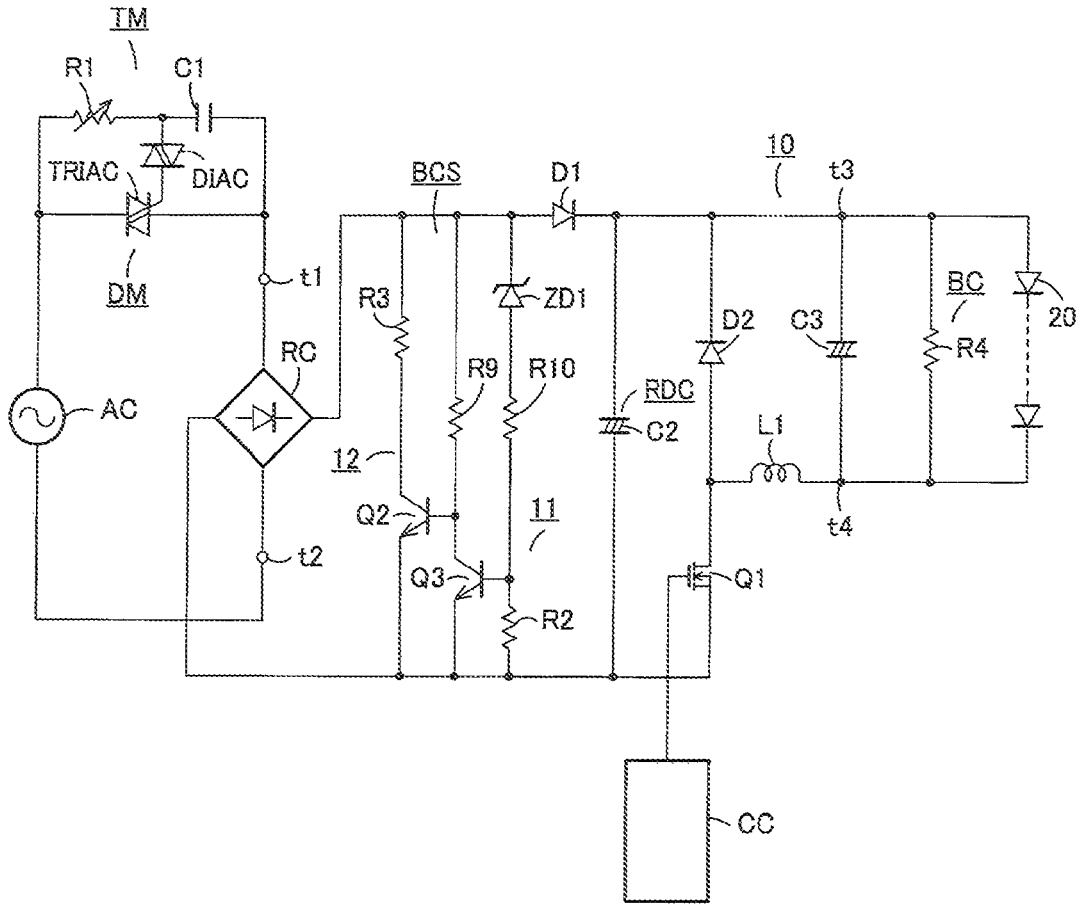
FIG. 1 is a circuit diagram of an LED lighting device of a first embodiment.

As shown in FIG. 1, the LED lighting device is constituted suitable for performing light control with use of a two-wire phase control type dimmer DM, includes a rectifying circuit RC, a converter 10, a control unit CC, a bleeder current extracting unit BCS and a bypass circuit BC, and lights an LED 20 as a load.

AC input ends t1 and t2 of the rectifying circuit RC are connected to an AC source AC. The rectifying circuit RC may be connected to the AC source AC directly or indirectly. In the case of a direct connection, the dimmer is disposed inside the LED lighting device. In the case of an indirect connection, for example, the rectifying circuit RC is connected to the AC source AC via the dimmer DM as shown in FIG. 1.

The dimmer DM is the two-wire phase control type dimmer and includes a phase control element TRIAC such as a triac and a timer circuit TM constituted by a time constant circuit. The phase control element TRIAC is connected in series to an AC line, and the timer circuit TM is connected in parallel with the phase control element TRIAC. The timer circuit TM includes the time constant circuit constituted by a series circuit consisting of a variable resistor R1 and a capacitor C1, a connection point of the variable resistor R1 and the capacitor C1 is connected to a gate electrode of the phase control element TRIAC via a trigger element DIAC.

When AC voltage is applied between a pair of input ends of the dimmer DM, the timer circuit TM first operates, and then potential of an output end of the time constant circuit reaches the trigger voltage of the trigger element DIAC. Thus, gate current flows into the gate electrode of the phase control element TRIAC from the time constant circuit via the trigger element DIAC, and the phase control element TRIAC is turned on.

Thus, since a time constant is changed by operating the variable resistor R1 and changing a resistance value thereof, a phase angle, that is, conduction angle, and accordingly a dimming degree, when the phase control element TRIAC is turned on is changed. Consequently, the dimmer DM changes an effective value of its output voltage in accordance with the dimming degree determined by operating the variable resistor R1.

The rectifying circuit RC is constituted by a bridge type full-wave rectifying circuit, and the pair of AC input ends t1 and t2 is connected to the AC source AC via the dimmer DM interposed in series. AC voltage is rectified that is phase-controlled by the dimmer DM and input via the pair of AC input ends t1 and t2.

A smoothing circuit can be added to the rectifying circuit RC. The smoothing circuit is constituted by a smoothing capacitor C2 connected between the DC output ends of the rectifying circuit RC. In FIG. 1, a diode D1 inserted between the DC output end of the rectifying circuit RC and the smoothing capacitor C2 is used for wrap around prevention. Accordingly, the rectifying circuit RC, the diode D1 and the smoothing capacitor C2 constitute a rectification DC source RDC.

The converter 10 converts DC voltage obtained from the rectifying circuit RC so that the voltage adapts to the LED 20 as a load, and the converter lights the LED 20. The converter. 10 is constituted by a step-down chopper and includes a switching element Q1, an inductor L1, a freewheel diode D2 and an output capacitor C3, and both ends of the output capacitor C3 are DC output ends t3 and t4. Moreover, an electrolytic capacitor having large capacitance is used for the output capacitor C3.

The control unit CC has at least a drive signal generating function and a positive characteristic feedforward control function of the switching element Q1. In the drive signal generating function, a drive signal of the switching element Q1 is generated and the switching element Q1 is driven. In the positive characteristic feedforward control function, source voltage phase-controlled by the dimmer DM is monitored, positive characteristic feedforward control is performed, and an on-duty of the switching element Q1 is converted to a PWM signal according to the source voltage. Thus, the on-duty of the switching element Q1 is changed in accordance with the source voltage and output current of the converter 10 is changed.

Moreover, based on a constitution described below, light control can be performed with use of the converter 10 and the control unit CC without the phase control type dimmer DM disposed outside. That is, the control unit CC generates a PWM signal in accordance with a light control operation signal, and modulates the drive signal of the switching element Q1 in the converter 10 by the PWM signal. Thus, output current of the converter 10 can be changed by PWM control in accordance with the dimming degree, and consequently the LED 20 can be subjected to light control and lit. Moreover, in this case, the light control operation signal may be generated with use of a light control operator disposed outside, or may be generated with use of the light control operator attached to the LED lighting device.

Regarding the step-down chopper constituting the converter 10, a series circuit consisting of the switching element Q1, inductor L1 and output capacitor C3 is connected to output ends of the rectification DC source RDC, that is, both ends of the smoothing capacitor C2, and the inductor L1, freewheel diode D2 and output capacitor C3 are connected to each other so as to form a closed circuit. When the switching element Q1 is turned on, an increasing current flows from the rectification DC source RDC into the series circuit consisting of the switching element Q1, inductor L1 and output capacitor C3 and the inductor L1 is charged. When the switching element Q1 is then turned off, a decreasing current flows from the inductor L1 via the freewheel diode D2 and the output capacitor C3 is charged. Both ends of the output capacitor C3 serve as output ends of the converter 10 and the LED 20 is connected to the output ends.

The bleeder current extracting unit BCS includes first and second bleeder current circuits 11 and 12, and both circuits are connected in parallel with the converter 10 so as to operate cooperatively. For the LED 20, the bleeder current extracting unit BCS dynamically extracts, in accordance with operation of the converter 10, current necessary for normally operating the two-wire phase control type dimmer DM even if lighting current of the LED 20 is much smaller than that flowing through an incandescent bulb or fluorescent lamp. Accordingly, the bleeder current extracting unit BCS is used in the case where the dimmer DM is a phase control type dimmer.

In a first bleeder current circuit 11, a series circuit consisting of a Zener diode ZD1, a resistor for restricting the current R10 and a bleeder resistor R2 is connected between the DC output ends of the rectifying circuit RC. When voltage between the DC output ends of the rectifying circuit RC is not lower than a predetermined voltage, for example, 50V, the Zener diode ZD1 becomes conductive and first bleeder current mainly determined by the resistor R10 and bleeder resistor R2 is extracted.

A second bleeder current circuit 12 is constituted by a bleeder resistor R3, a bias resistor R9 and switches Q2 and Q3. That is, a series circuit consisting of the bleeder resistor R3 and the switch Q2 is connected between the DC output ends of the rectifying circuit RC. The switch Q3 is connected so that a predetermined interlocking operation is performed between the switch Q2 and the first bleeder current circuit 11. Here, the predetermined interlocking operation means that the second bleeder current circuit 12 is not operated while the first bleeder current circuit 11 operates and the first bleeder current flows.

Accordingly, the switch Q2 can be turned on when the first bleeder current circuit 11 does not operate by the bias resistor R9. A very small amount of second bleeder current is sufficient to operate the timer circuit TM in order to turn on the phase control element TRIAC of the dimmer DM. The first bleeder current is extracted during a period from a rise of AC voltage to a time when the phase control element TRIAC is turned on. During a period from the time when the phase control element TRIAC is then turned on to the end of a half-wave of AC voltage, as described later, the Zener diode ZD1 of the first bleeder current circuit 11 is turned on and therefore the switch Q3 is turned on and the switch Q2 is turned off. In addition, during a period of the low voltage before the end of a half-wave of AC voltage, the Zener diode ZD1 is turned off again and the switch Q2 is turned on. Accordingly, the first bleeder current flows and holding current of the phase control element TRIAC is secured.

The bypass circuit BC is constituted by a resistor R4 connected between the DC output ends t3 and t4 of the converter 10 in parallel with the LED 20 as a load. The resistor R4, in a dimming range, makes bypass current flow and increases a load viewed from the converter 10, the bypass current being larger than lighting current which flows through the LED 20.

Next, circuit operation will be described.

In FIG. 1, in the case where the dimmer DM is operated and a proper dimming degree is set, when the AC source AC is switched on, AC voltage is, during each half-wave of the AC voltage, applied to a closed circuit which consists of: the time constant circuit consisting of the variable resistor R1 and capacitor C1 of the timer circuit TM of the dimmer DM; the rectifying circuit RC; and a series circuit consisting of the resistor R3 and switch Q3 of the first bleeder current circuit 12 of the bleeder current extracting unit BCS. Since the switch Q2 is turned on by application of the AC voltage and the second bleeder current flows through the closed circuit, the timer circuit TM of the dimmer DM starts timer operation and terminal voltage of the capacitor C1 increases.

Moreover, although voltage is here applied also to the first bleeder current circuit 11, the timer circuit TM has a high impedance, voltage applied to the Zener diode ZD1 is here low and thus the Zener diode ZD1 is kept in an off-state. Consequently, the first bleeder current circuit 11 does not operate, and the first bleeder current does not flow.

When the terminal voltage of the capacitor C1 of the timer circuit TM then rises and reaches the trigger voltage of the trigger element DIAC, the trigger element DIAC becomes conductive, trigger current flows into a trigger electrode of the phase control element TRIAC from the capacitor C1, and thus the phase control element TRIAC is turned on. Consequently, in a half-cycle of the AC voltage, AC voltage after a phase angle when the phase control element TRIAC is turned on, that is, phase-controlled AC voltage, is applied between the pair of AC input ends t1 and t2 of the rectifying circuit RC.

Since voltage drop by the dimmer DM is almost eliminated when the phase-controlled AC voltage is rectified by the rectifying circuit. RC and appears at the DC output ends of the rectifying circuit RC, voltage higher than the predetermined voltage is applied to the first bleeder current circuit 11. Thus, the Zener diode ZD1 becomes conductive, and the first bleeder current flows through a series circuit consisting of the Zener diode ZD1 and the bleeder resistor R2. The first bleeder current has a value capable of holding an on-state of the phase control element TRIAC even if the converter 10 is not operated. Accordingly, the phase control element TRIAC of the dimmer DM is kept in a turn-on state during the half-cycle of the AC voltage.

On the other hand, when the AC voltage phase-controlled by the dimmer DM is rectified by the rectifying circuit RC and DC voltage smoothed by the smoothing capacitor C2 is applied to the converter 10, the control unit CC monitors the phase-controlled AC voltage in its inside (not shown). The input AC voltage is converted to a PWM signal having an on-duty corresponding to a conduction angle of the dimmer DM by the positive characteristic feedforward control, and a drive signal is generated based on the PWM signal and supplied to the switching element Q1.

Thus, the switching element Q1 performs high-frequency switching at the on-duty corresponding to the PWM signal. Consequently, the converter 10 outputs DC current having a value corresponding to the dimming degree of the dimmer DM between the DC output ends t3 and t4 to which the output capacitor C3 is connected in parallel. Thus, the LED 20 connected to the output ends is subjected to the light control and lit in accordance with the dimming degree of the dimmer DM.

On the other hand, the bypass circuit BC is connected in parallel between the DC output ends t3 and t4 of the converter 10 and makes current larger than lighting current, which flows through the LED 20, flow as dummy load current in the dimming range. Thus, since load current output from the converter 10 is increased by the lighting current and the dummy load current being added, fluctuation in output current is suppressed and flickering of the LED 20 is reduced at least in the vicinity of the dimming lower limit.

Further, the reason why it is difficult for flickering of the LED 20 to occur will be described with reference to FIG. 2.

Figure 2:
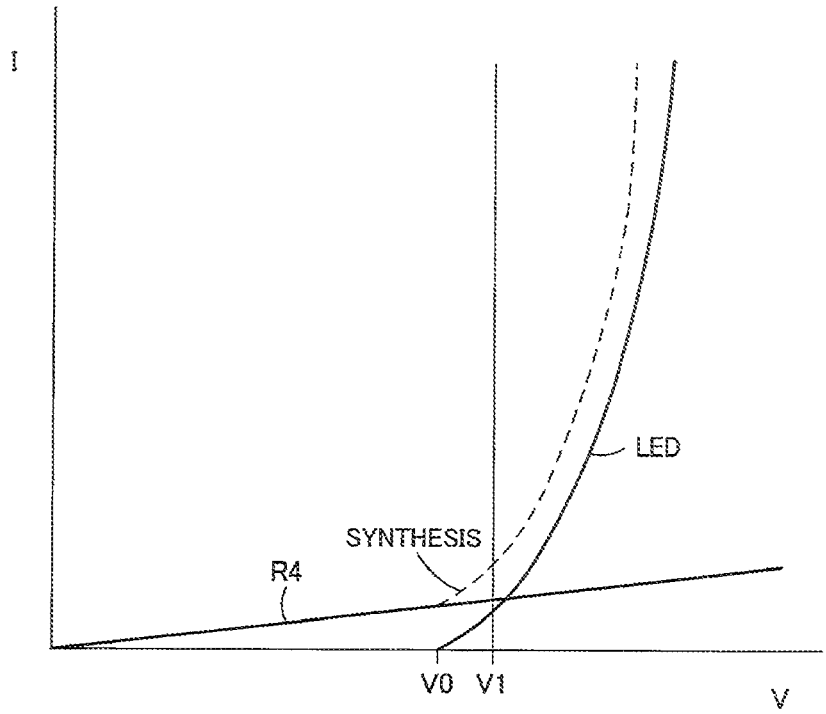
FIG. 2 is a graph indicating current-voltage properties of an LED and a bypass circuit of the LED lighting device.

FIG. 2 is a graph indicating voltage-current properties of the LED 20 and the bypass circuit BC in the first embodiment. In FIG. 2, the horizontal axis indicates relative values of voltage V and the vertical axis indicates relative values of current I. In FIG. 2, a curve "LED" indicates the voltage-current property of the LED, a curve "R4" indicates the voltage-current property of the bypass circuit BC and a curve "Synthesis" indicates the voltage-current property of a circuit obtained by synthesizing the LED and the bypass circuit BC with each other. Additionally, a point V0 of the horizontal axis indicates conduction start voltage of the LED 20, and a point V1 indicates terminal voltage of the LED 20 at the dimming lower limit.

As shown in FIG. 2, the dummy load current flows only through the bypass circuit BC before a start of conduction of the LED 20. Output current of the converter 10 flowing in this state linearly changes along the voltage-current property curve "R4" by the resistor R4 of the bypass circuit BC in relation to a change in voltage. When the output voltage of the converter 10 is not smaller than V0, output current of the converter 10 changes along the curve "Synthesis." That is, the curve "Synthesis" is the same as the curve "R4" in a region of the conduction start point V0 of the LED 20 or smaller, and the output current changes along the curve "Synthesis" after reaching the conduction start point and continuously changes even at a connection portion of the curve "R4" and the curve "Synthesis" in relation to the change in the voltage in the vicinity of the conduction start point.

Accordingly, since the output current of the converter 10 does not suddenly change even in the vicinity of the dimming lower limit and thus also current, which flows into the LED 20, does not suddenly change, it is considered that no flickering of the LED 20 at the conduction start point occurs.

Additionally, although the LED lighting device includes neither unit for detecting load current, unit for amplifying a detection signal of the load current, nor control unit for negative-feedback-controlling the switching element Q1 of the converter 10, flickering of the LED 20 easily occurring in a deep dimming region is reduced and desired light control can be performed. Thus, a circuit constitution of the LED lighting device becomes simple, and the LED lighting device is made low-priced and downsized.

In an example of the LED lighting device, seven LED elements each having a voltage drop of 3V in 100% lighting to a rated voltage are used for the LED 20, connected in series to each other and connected between the DC output ends t3 and t4, and here a lighting current of 0.27 A flows. Moreover, in 0% lighting to the rated voltage, the value of voltage drop is 2.1V and a lighting current of 0.001 A flows.

Here, regarding the bypass circuit BC, the resistor R4 has a resistance value of 10 kΩ and a bypass current of 0.00147 A in 0% lighting to the rated voltage flows.

Regarding the above example of the LED lighting device, it was confirmed that flickering of various LEDs 20 generally used can be reduced in a range of 5-20 kΩ of the resistance value of the resistor R4.

Next, a second embodiment will be described with reference to FIG. 3. Moreover, the same symbols are attached to the same structures as those of the first embodiment shown in FIG. 1 and description thereof will be omitted.

The second embodiment is different from the first embodiment in a point that the bypass circuit BC operates only in the vicinity of the dimming lower limit.

That is, the bypass circuit BC includes a switch Q4 and a lighting current response circuit CIC. The switch Q4 is connected in series to the resistor R4 of the bypass circuit BC. The lighting current response circuit CIC includes a current detecting unit R5, a switch Q5 and a resistor R6. The current detecting unit R5 is constituted by a lighting current detecting resistor inserted in series with the LED 20. The switch Q5 is connected in series to the resistor R6 and connected in parallel to the LED 20 so that the current detecting unit R5 is turned on when current having a value not smaller than a predetermined value flows into the current detecting unit R5. Moreover, as the predetermined value, for example, a value of lighting current flowing in the vicinity of the dimming lower limit can be set. Additionally, a connection point between the resistor R6 and the switch Q5 is connected to a control electrode of the switch Q4.

When the LED 20 is lit and lighting current having a value not smaller than the predetermined value flows, the switch Q5 responds to the lighting current and is turned on. When the switch Q5 is turned on, the switch Q4 connected in series to the resistor R4 is turned off. Consequently, bypass current flowing in the bypass circuit BC is blocked by the switch Q4.

Therefore, according to the LED lighting device of the second embodiment, in the vicinity of the dimming lower limit of the LED 20, the bypass circuit BC can be operated only when the LED 20 is lit in a region where flickering easily occurs by a slight fluctuation in the lighting current.

Next, a third embodiment will be described with reference to FIGS. 4 and 5. Moreover, the same symbols are attached to the same structures as those of the first embodiment shown in FIG. 1 and description thereof will be omitted.

The third embodiment is different from the first embodiment in a point that the bypass circuit BC is constituted by a constant current circuit.

That is, a well-known circuit constitution can be employed for the constant current circuit of the bypass circuit BC. In the constant current circuit shown in FIG. 4, switches Q6 and Q7 and resistors R7 and R8 are connected as shown in FIG. 4, a conduction degree of the switch Q7 is controlled in accordance with voltage drop of the resistor R7, and thus a conduction degree of the switch Q6 is controlled by the switch Q7 and bypass current flowing in the switch Q6 is controlled to be constant.

According to the LED lighting device of the third embodiment, since current flowing through the resistor R7 is made into a constant current with use of the switches Q6 and Q7, a resistance value of the resistor R7 can be made smaller than that of the resistor R4 of the first embodiment shown in FIG. 1. Consequently, consumption power of the resistor R7 can be reduced.

Figure 5:
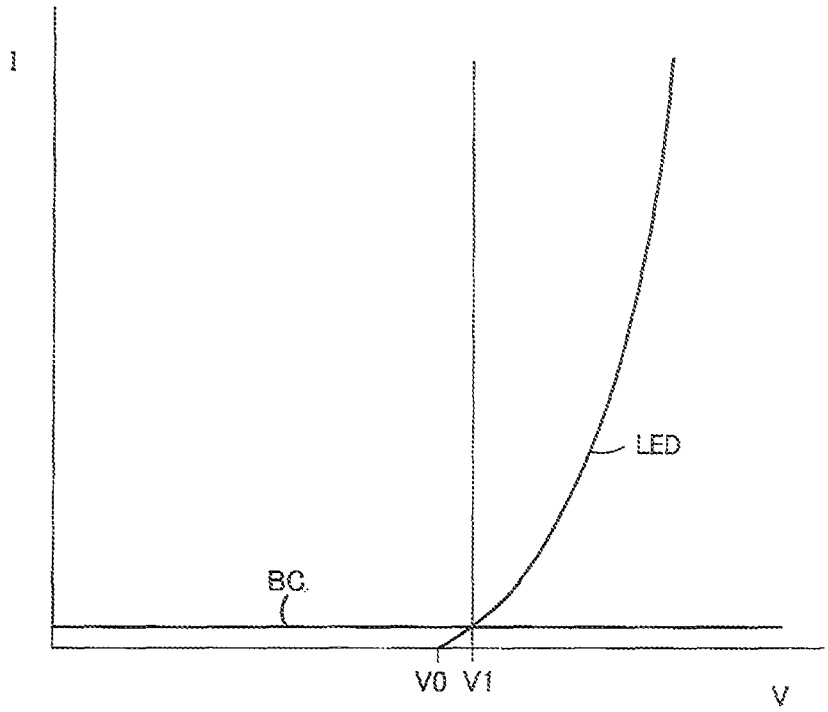
FIG. 5 is a graph indicating current-voltage properties of an LED and a bypass circuit of the LED lighting device.

FIG. 5 is a graph indicating voltage-current properties of the LED 20 and the bypass circuit BC of the third embodiment. Moreover, the same symbols, in FIG. 5, are attached to the same parts as those in FIG. 2 and description thereof will be omitted. As shown in FIG. 5, since the bypass circuit BC is the constant current circuit, a line indicating the voltage-current property of the bypass circuit BC is a straight line parallel with the horizontal axis as indicated by a line "BC."

As described above, according to the embodiment, there can be provided an LED lighting device capable of reducing flickering, which easily occurs in the vicinity of the dimming lower limit, of the LED 20 because the bypass circuit BC provided in the LED lighting device makes bypass current flow, the bypass current being larger than lighting current, which flows through the LED 20, in the vicinity of the dimming lower limit.

Figure 6:
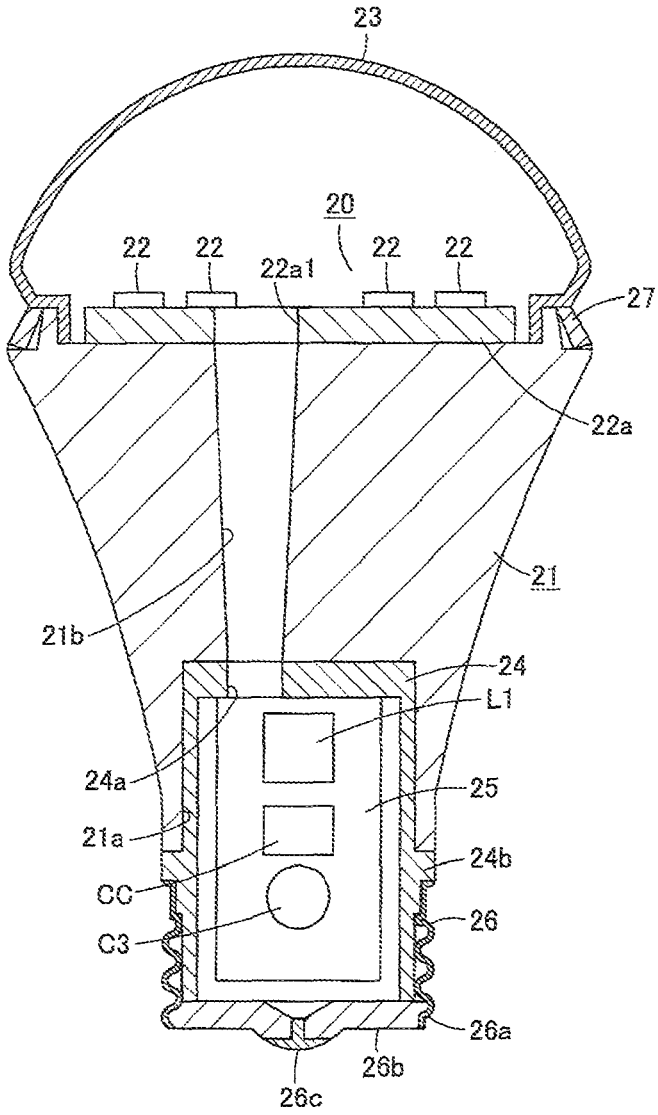
FIG. 6 is a vertical cross sectional view of an LED bulb which is an illumination apparatus including the LED lighting device of each of the embodiments.

FIG. 6 shows an LED bulb as an example of an illumination apparatus including the LED lighting device. Moreover, the same symbols are attached to the same structures as those of each of the embodiments and description thereof will be omitted.

The illumination apparatus (LED bulb) includes, as main components, an illumination apparatus main body (lamp main body) 21, the LED 20, a globe 23, an insulating case 24, an LED lighting circuit substrate 25 and a cap 26.

The illumination apparatus main body 21 is composed of a heat conductive substance such as aluminum, and forms a circular cone, and in FIG. 6, mechanically supports the LED 20 at an upper end of the main body 21 while forming a heat conductive relationship between the main body 21 and the LED 20. Additionally, the insulating case 24 is housed in a recessed portion 21*a* formed in a lower part of the main body 21. Further, the illumination apparatus main body 21 includes a through hole 21*b* vertically penetrating the illumination apparatus main body 21. Furthermore, the illumination apparatus main body 21 can have a heat radiating fin formed on its outer face so as to increase a heat radiation area.

The LED 20 has a plurality of LED modules 22, and the LED modules 22 are mounted on a circular substrate 22*a*. Additionally, the substrate 22*a* has a wiring hole 22*a*1 at a position corresponding to the through hole 21*b* of the illumination apparatus main body 21. Further, the substrate 22*a* is mainly composed of a heat conductive substance such as aluminum so that heat generated in the LED 20 conducts to the illumination apparatus main body 21 via the substrate 22*a*. The plurality of LED modules 22 are connected to the LED lighting circuit substrate 25 via conductive lines (not shown) wired via the through hole 21*b* and the wiring hole 22*a*1.

The globe 23 is attached to the upper end of the illumination apparatus main body 21 in FIG. 6 so as to surround the LED 20 including the plurality of LED modules 22, protects a charging portion of the LED 20 and mechanically protects the LED 20. Moreover, if necessary, alight controlling unit (not shown), for example, a light diffusing unit may be disposed on or formed integrally with the globe 23 so as to control light distribution characteristics. Moreover, in an external appearance, a ring 27 having an inclined face disposed at a border portion between the globe 23 and the illumination apparatus main body 21 has an outer face having reflectivity, reflects light radiated downward in FIG. 6 from the globe 23 and has a function to correct the light distribution characteristics.

The insulating case 24 is composed of an insulative substance with respect to the illumination apparatus main body 21, for example, plastics or ceramics, and housed in the recessed portion 21*a* of the illumination apparatus main body 21, and houses the LED lighting circuit substrate 25 therein. Additionally, in a state where the insulating case 24 is cylindrical, a lower end thereof is opened, housed in the recessed portion 21*a* of the illumination apparatus main body 21, an upper end thereof is a block end having a wiring hole 24*a* formed corresponding to the through hole 21*b* of the illumination apparatus main body 21 and the case 24 includes a flange portion 24*b* on an outer face of its middle portion. The flange portion 24*b* comes into contact with the lower end of the illumination apparatus main body 21 in FIG. 6 with the insulating case 24 housed in the recessed portion 21*a* of the illumination apparatus main body 21.

Figure 3:
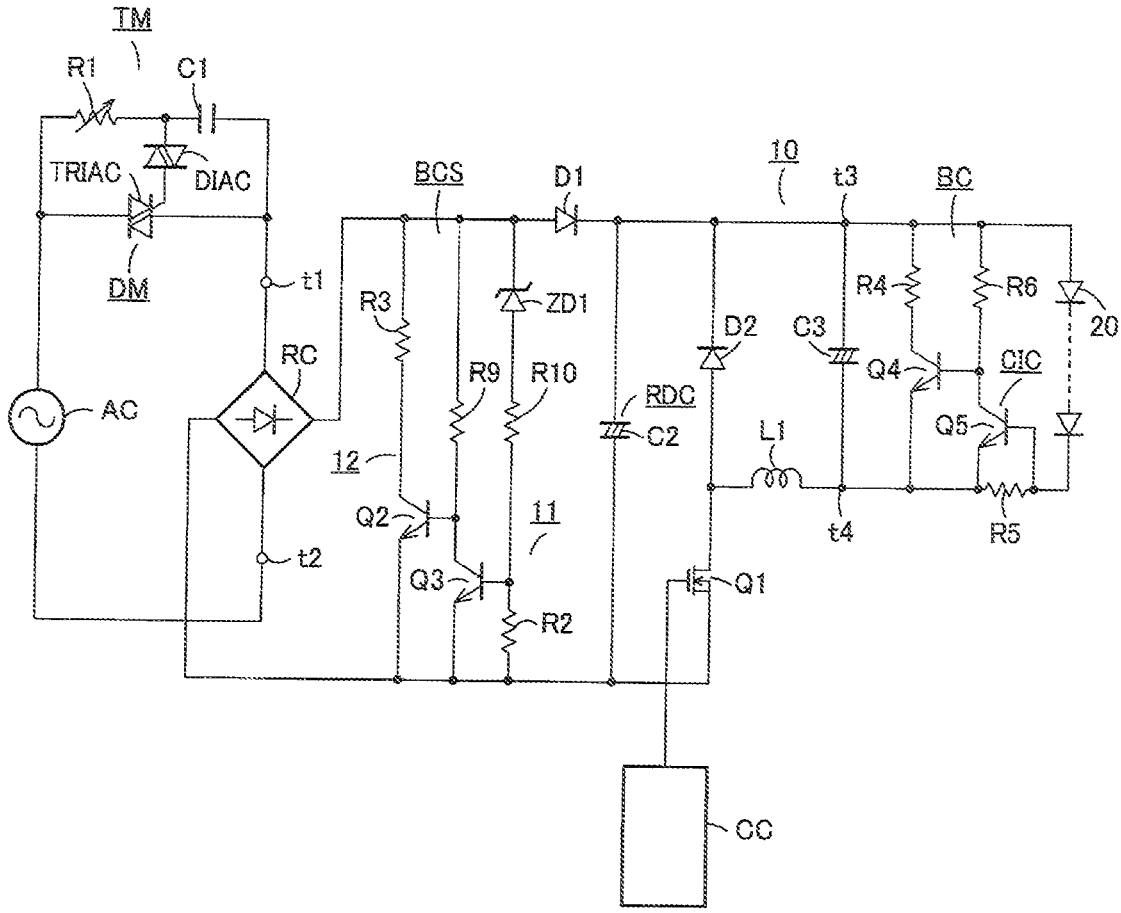
FIG. 3 is a circuit diagram of an LED lighting device of a second embodiment.
Figure 4:
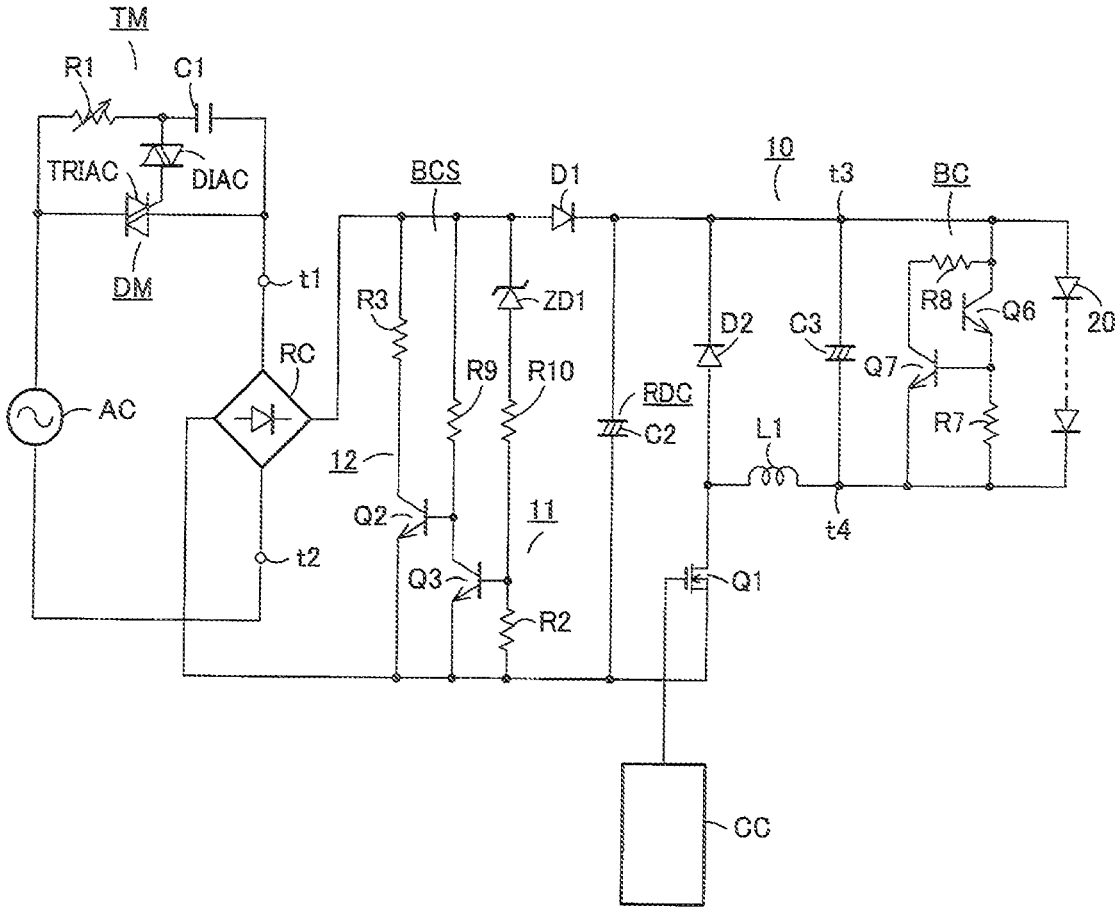
FIG. 4 is a circuit diagram of an LED lighting device of a third embodiment.

The LED lighting circuit substrate 25 is housed in the insulating case 24 with the LED lighting circuit LOC in FIG. 1, 3 or 4 mounted on the substrate. In FIG. 6, the circuit components, to which the same symbols as those shown in FIG. 1, 3 or 4 are attached, are relatively large. The other circuit components are relatively small and not shown, but they are also mounted on the backside of the LED lighting circuit substrate 25 in FIG. 6.

The cap 26 is an E26 type screw cap attached to a lower part of the insulating case 24, and closes a lower opening end of the insulating case 24. That is, the cap 26 has a cap shell 26*a*, an insulating body 26*b* and a center contact 26*c*. The cap shell 26*a* is attached to the lower part of the insulating case 24, has an upper end brought into contact with the flange portion 24*b* of the insulating case 24 in FIG. 6, and is connected to one of the AC input terminals t1 or t2 of the LED lighting circuit substrate 25 via a lead wire (not shown). The insulating body 26*b* blocks a lower end of the cap shell 26*a* in the figure of the cap 26*a* and supports the center contact 26*c* so that the center contact 26*c* is insulative to the cap shell 26*a*. The center contact 26*c* is connected to the other AC input terminal t1 or t2 of the LED lighting circuit substrate 25 via a lead wire (not shown).

Since the illumination apparatus includes the LED lighting device of the above embodiments, it can reduce flickering, which easily occurs in the vicinity of the dimming lower limit, of the LED 20.

Moreover, as the converter 10, various converters such as a step-up chopper and a switching regulator can be properly employed in addition to the step-down chopper. However, since voltage to be applied to a load circuit becomes low when a small LED 20 having a relatively small amount of light is lit with use of a commercial AC source, the step-down chopper is suitable. Even when any of the above converters is used, input ends of the converter 10 are connected to the DC output ends of the rectifying circuit RC, the output capacitor C3 is connected in parallel to output ends of the converter 10 and continued DC current is output from the converter 10. In this point, the above converters are common with each other.

Additionally, any constitution may be adopted in the control unit CC if it controls the converter 10 so as to subject the LED 20 to light control and light the LED 20 and controls lighting current of the LED 20 so that the lighting current has a value corresponding to the dimming degree. For example, in the case where the light control is performed via the outside phase control type dimmer DM, a constitution can be adopted that an on-duty of a PWM signal is changed in accordance with input voltage by feedforward control and the lighting current corresponding to the dimming degree is output. Additionally, in the case where a dimming unit is disposed in the LED lighting device, a constitution can be adopted that the on-duty of the PWM signal is directly changed in accordance with the dimming degree.

Additionally, the bypass circuit BC provides the converter 10 with a dummy load in addition to a load of the LED 20 and increases the output current of the converter 10 at least in the vicinity of the dimming lower limit. Thus, the output current of the converter 10, as bypass current, first starts flowing to the bypass circuit BC before a start of lighting the LED 20, a light load state viewed from the converter 10 is removed, the converter 10 is stably operated, and thereafter the lighting current of the LED 20 starts flowing.

Thus, when little lighting current flows through the LED 20 in the vicinity of the dimming lower limit, the slight fluctuation in the lighting current is remarkably decreased, because the converter 10 has supplied the bypass current before the little lighting current flows. Consequently, generation of flickering of the LED 20 in the vicinity of the dimming lower limit is suppressed. It is understood that it is better, in order to perform such circuit operation, that the bypass current, which flows through the bypass circuit BC, is larger than the lighting current, which flows through the LED 20, throughout the dimming range or at least in the vicinity of the dimming lower limit.

The dimming lower limit may range from a current rise point of the voltage-current property curve of the LED 20 to a region, where a current rise gradient of the property curve is relatively small, and the vicinity of the region, and may be included in a range that deep dimming is performed.

In the case where dimming shallower than that at the dimming lower limit is performed for the LED 20, lighting current (load current) for energizing the LED 20 becomes relatively large, the amount of light increases and thus the visual sensation of a person makes it relatively difficult to sense flickering of the LED 20. Additionally, since the converter 10 is stably operated and the slight fluctuation in current is reduced accordingly, flickering of the LED 20 is really reduced.

Thus, in the case where the dimming shallower than that at the dimming lower limit is performed for the LED 20, although the bypass current is not always required to flow through the bypass circuit BC, it is particularly allowed to continuously operate the bypass circuit BC if a proper circuit efficiency reduction is permitted. Additionally, the circuit constitution becomes simple.

However, in the case where consumption power is required to be suppressed to the utmost by stopping the operation of the bypass circuit BC while the LED 20 is subjected to dimming other than deep dimming and lit, lighting current of the LED 20 is detected and the bypass circuit BC is controlled in accordance with a lighting state of the LED 20 so as not to be operated when the lighting current exceeds the predetermined value.

As long as the bypass circuit BC makes bypass current flow, the bypass current being larger than lighting current, which flows through the LED 20, at least in the vicinity of the dimming lower limit, any constitution is applicable. Moreover, preferably, a resistor or constant current circuit, as a main component, constitutes the bypass circuit.

Additionally, the illumination apparatus is a concept in which various apparatuses for performing illumination by using an LED as a light source are contained. For example, lighting equipment or a marker lamp is cited which includes an LED bulb or LED light source substitutable for various lamps such as an incandescent bulb, fluorescent lamp and high-pressure discharge lamp as existing lighting sources. Additionally, the illumination apparatus main body is a portion which remains after removing the LED lighting device and LED from the illumination apparatus.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An LED lighting device comprising:

a rectifying circuit having AC input ends connectable to an AC source;

a step-down converter configured to light the LED lighting device, the converter comprising:

input ends connectable to DC output ends of the rectifying circuit, and output ends, to which an output capacitor of the step-down converter is connected in parallel, connected to an LED;

a control unit configured to change continued DC output current of the converter in accordance with a dimming degree of a dimmer to which AC voltage is applied; and a bypass circuit connected to the output ends of the converter in parallel with the output capacitor and configured to reduce fluctuation in the DC output current to the LED lighting device by making bypass current flow, the bypass current being larger than a lighting current at least in the vicinity of a dimming lower limit of the LED, wherein the lighting current flows through the LED and wherein the bypass circuit is configured such that bypass current bypasses the LED, wherein the bypass circuit is controlled so as to make bypass current flow only in a predetermined range of the vicinity of the dimming lower limit of the LED.

2. An illumination apparatus comprising:

an illumination apparatus main body;

the LED lighting device according to claim 1 which is disposed on the illumination apparatus main body; and the LED which is connected to output ends of the LED lighting device and disposed on the illumination apparatus main body.

* * * * *